United States Patent [19]

Tokuno

[11] 4,103,786

[45] Aug. 1, 1978

[54] BOARD PILING-UP APPARATUS

[75] Inventor: Masateru Tokuno, Nishinomiya, Japan

[73] Assignee: Rengo Co., Ltd., Osaka, Japan

[21] Appl. No.: 712,046

[22] Filed: Aug. 6, 1976

[30] Foreign Application Priority Data

Oct. 11, 1975 [JP] Japan ..... 50-136109

[51] Int. Cl.[2] ..... B65G 57/28

[52] U.S. Cl. ..... 214/7; 93/93 DD; 214/6 C; 271/214

[58] Field of Search ..... 214/6 C, 7; 271/213, 271/214, 221; 93/93 DP

[56] References Cited

U.S. PATENT DOCUMENTS

| | | | |
|---|---|---|---|
| 3,643,939 | 2/1972 | Nussbaum et al. | 214/6 C X |
| 3,691,915 | 9/1972 | Kiela et al. | 214/7 X |
| 3,884,345 | 5/1975 | Tokuno | 214/6 C X |
| 3,887,088 | 6/1975 | Fernandez-Rama et al. | 214/6 C |
| 3,974,921 | 8/1976 | Tokuno | 214/7 |

FOREIGN PATENT DOCUMENTS

| | | | |
|---|---|---|---|
| 766,133 | 4/1934 | France | 271/214 |

*Primary Examiner*—L. J. Paperner

*Attorney, Agent, or Firm*—Birch, Stewart, Kolasch & Birch

[57] ABSTRACT

This invention relates to apparatus for piling up boards such as corrugated boards. More particularly, it relates to a board piling-up apparatus wherein boards, such as corrugated boards, which are individually fed lying flat or in the form of small bundles and which are erected by a hand in the course of the feed to thereby be collected in the erected posture, the collected boards are turned to be piled up, and the boards piled up are thereafter discharged.

15 Claims, 3 Drawing Figures

BOARD PILING-UP APPARATUS

BACKGROUND OF THE INVENTION

1. Field of the Invention

This invention relates to an apparatus for piling up boards such as corrugated boards. More particularly, it relates to a board piling-up apparatus wherein boards, such as corrugated boards, which are individually fed lying flat or in the form of small bundles and which are erected by a hand in the course of the feed to thereby be collected in the erected posture, the collected boards are turned to be piled up, and the boards piled up are thereafter discharged.

2. Prior Art

Heretofore, the job of forming a high pile of boards for the purposes of storage, transportation, etc., the boards being individually fed lying flat or in the form of small bundles, has been mainly a hand operation. Therefore, the job has been extremely inefficient, and it has been difficult to pile up the boards accurately to a desired height.

SUMMARY OF THE INVENTION

It is an object of the present invention to provide an apparatus wherein boards which are individually fed lying flat or in the form of small bundles are promptly and reliably piled up in a predetermined number. More particularly, a board piling-up apparatus wherein only the simple job of erecting individual or small-bundle boards fed in a laid-down state and the simple job of pushing the erected boards against an arranging device to make the positioning of the side ends of the boards uniform rely on a hand operation. Further, the difficult job of collecting the erected boards and turning them to be piled up and thereafter discharging the boards piled up does not rely on a hand operation.

Another object of the present invention is to provide a board piling-up apparatus wherein in order to collect the erected boards, board supports for supporting the erected boards reciprocate between a position of the initiation of board reception and a refuge position at the turning of the boards for piling-up, whereby returning paths which are separate from going paths of said board supports and which are necessary when the board supports move on endless tracks in one direction are not necessary in the present invention.

Still another object of the present invention is to provide a board piling-up apparatus equipped with a stopper device which can support and accumulate the erected boards even while the collected boards are being piled up and discharged, i.e., while the board supports do not lie at board receiving positions.

The apparatus for accomplishing the objects comprises a first conveyor which receives the boards fed in the laid-down state in that posture and on which said boards are erected; an arranging device which is disposed on one side of said first conveyor in order to push against the side ends of said boards erected on said first conveyor and to thus make the positioning of said side ends of the boards uniform; a second conveyor which has board supports capable of reciprocating between a feed end and a delivery end along with transporting members, which successively receives said boards erected on said first conveyor until a predetermined number is reached, and which feeds said boards while supporting them by said board supports; a stopper device which can protrude above said delivery end of said first conveyor to support said boards erected on said first conveyor; a piling-up device which has a scooping bed and a piling-up bed extending from said scooping bed substantially perpendicularly thereto, and said scooping bed is capable of lifting and turning said boards fed to a predetermined position by said second conveyor and piles them up on said piling-up bed; and a device which discharges said boards from said piling-up bed.

A further object of the present invention is to provide a board piling-up apparatus wherein the arranging device comprises a front plate being substantially vertical and a rear plate being substantially vertical and being somewhat behind said front plate in order to zigzag the side portion of the piled-up boards so that, where the boards are stacked by reversing the front and rear sides at every ten and several sheets to the end for preventing warping of the boards at the piled-up storage of the boards, the boards whose surfaces face upwards and the boards whose surfaces face downwards may be immediately distinguishable.

A still further object of the present invention is to provide a board piling-up apparatus wherein the first conveyor is a belt conveyor so that the boards laid down may be easily erected to prevent damage.

A yet further object of the present invention is to provide a board piling-up apparatus wherein in order that the board supports may be reliably operated, the second conveyor is a chain conveyor, and the lower end parts of the board supports are coupled to the conveyor chains and are also fitted in rail members parallel to said conveyor chains.

Yet another object of the present invention is to provide a board piling-up apparatus wherein in order to obtain a inexpensive and simple apparatus, the scooping bed of the piling-up device is the second conveyor itself.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
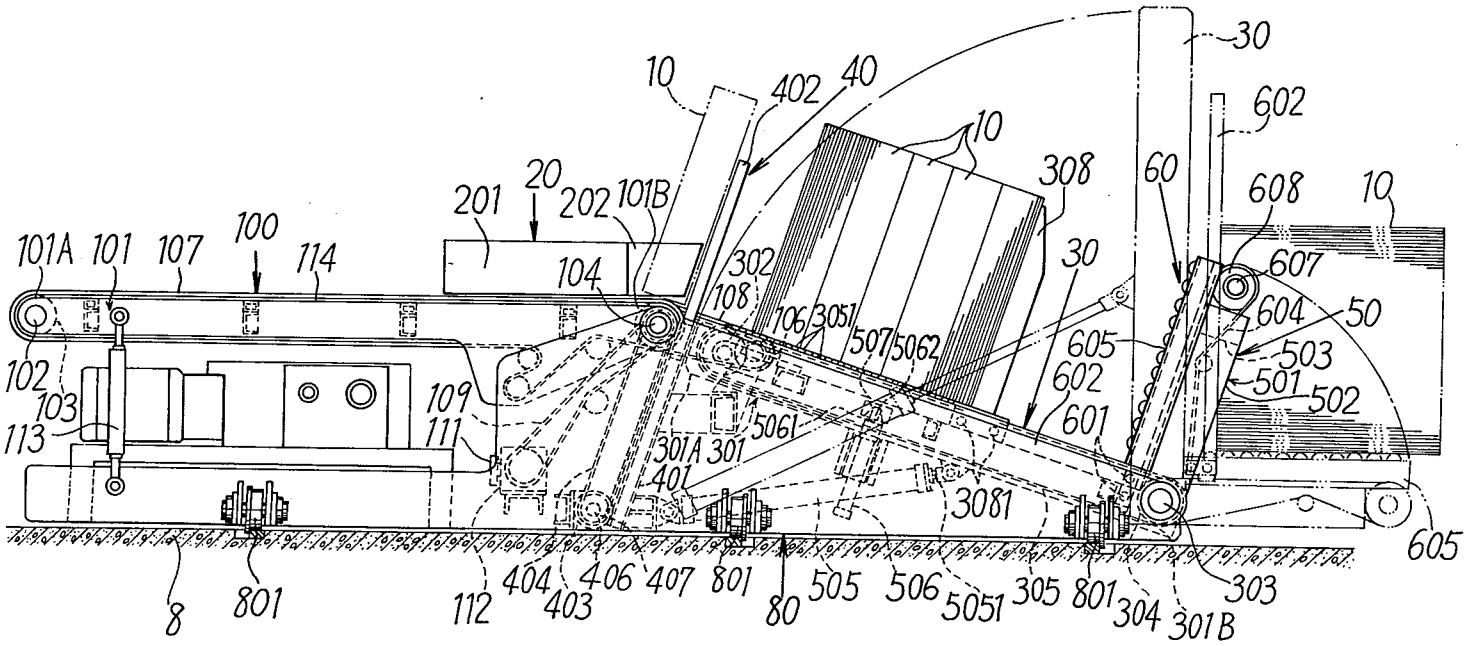
FIG. 1 is a side view of the board piling-up apparatus of the present invention.

An embodiment of the present invention will now be described with reference to FIGS. 1 to 3. The apparatus is composed of a first conveyor 100, an arranging device 20, a second conveyor 30, a stopper device 40, a piling-up device 50, and a discharge device 60.

The first conveyor 100 includes four feed end pulleys 103 which are secured to a shaft 102 rotatably supported at one end 101A of a conveyor frame 101 and four delivery end pulleys 105 which are secured to a shaft 104 rotatably supported at the other end 101B of the frame 101. In addition, auxiliary pulleys 106 are rotatably arranged at positions somewhat behind the two middle pulleys 105 and somewhat below the same, endless belts 107 are extended over the pulleys 103 and 105 at both the ends, endless belts 108 which are extended over the middle pulleys 103 and 105 and the pulleys 106. Also, a motor 112 drives the pulley shaft 104 through a chain transmission 109, a reduction gear 110 and a belt transmission 111. So that the end 101A of the conveyor frame 101 may be movable upwards and downwards, the pulley shaft 104 of the frame end 101B is rotatably supported on a stationary frame 80 erected on a foundation 8. The frame end 101A is supported on the frame 80 through turnbuckles 113 for adjusting the height of the end 101A. The auxiliary pulleys 106 are rotatably mounted on the stationary frame 80. The endless belts 107 and 108 are supported by plates 114 and 115 secured to the conveyor frame 101 and plates 116 secured to the frame 80.

The arranging device 20 is composed of a front plate 201 which is substantially vertical and which is erected on one side of the first conveyor 100 along the conveyor, and a rear plate 202 which is substantially vertical and which is erected behind the front plate 201 so as to protrude beyond the rear end of the front plate 201 when the rear plate is viewed in the direction orthogonal to the feed direction of the conveyor 100. A front end part of the front plate 201 is curved towards the rear plate 202. A vertical front plate 201 and a vertical rear plate 202 are fixed to a supporting member 203, which is slidably mounted on supporting rods 205 of a supporting rest 204 extending from the stationary frame 80. A threaded rod 206 is rotatably mounted on the supporting rest 204. A female screw portion 207 of the member 203 is threadably engaged with the threaded rod 206. When the threaded rod 206 is driven through a chain transmission 208 by a motor 209, the front plate 201 and the rear plate 202 can be moved closer to or to or get away from the conveyor 100.

The second conveyor 30 is composed of three pairs of sprockets 302 which are rotatably mounted on one end 301A of a conveyor frame 301, three pairs of sprockets 304 which are secured to a shaft 303 rotatably supported on the other end 301B of the frame 301. In addition, three pairs of chains 305 are extended over the sprockets 302 and 304. Also, a motor with a brake and a reduction gear 307 provides drive to the shaft 303 through a chain transmission 306, and board supports 308 can reciprocate along with the chains 305. The sprocket shaft 303 at the frame end 301B is at a position lower than the auxiliary pulleys 106 of the first conveyor 100, and it is also rotatably supported on the stationary frame 80 in such a manner that the frame 301 may be pivotable. By the pivoting of the conveyor frame 301, the sprockets 302 at the frame end 301A can be snugly engaged with those parts of the belts 108 of the first conveyor 100 which extend from the delivery end pulleys 105 to the auxiliary pulleys 106 and with both the outer sides of the belt parts. Each pair of chains 305 have slats 3051 at a part to place boards thereon, and slide on rails (not shown) secured to the conveyor frame 301. Each board suport 308 consists of a rod which is substantially orthogonal to the transportation surface of the conveyor. Both the ends of the paired chains 305 are coupled to the lower end of the support 308. Further, the lower end of the support 308 has wheels 3081. The wheels fit in a pair of groove-shaped rail members 309 which are parallel to the chains 305 and which are secured to the conveyor frame 301. Thus, the support 308 maintains a predetermined posture.

The stopper device 40 is composed of two rods 402 which fit in vertical guide members 401 fixed to the stationary frame 80 and which can protrude above the delivery end of the conveyor 100. Endless chains are coupled to the rods 402 so as to move them up and down by means of a motor 403. The motor 403 is hydraulically operated. Each endless chain 404 is extended over an upper sprocket 405 which is rotatably fitted on the delivery end pulley shaft 104 of the conveyor 100, and a lower sprocket 407 which is secured to a shaft 406 driven by the motor 403.

The piling-up device 50 is composed of the conveyor 30 which is used as a scooping bed, and a piling-up bed 501 which extends from the delivery end of the conveyor 30 perpendicularly to the transportation surface of the conveyor. The piling-up bed 501 consists of two parallel rod-like vertical member 502 with lower ends thereof secured to the conveyor frame end 301B, a horizontal member 503 is secured to the upper end of the frame 502, and two pairs of parallel groove-shaped rod members 504. Each pair of groove-shaped rod members 504 have their grooves confronted each other, and upper parts of the members are secured to the horizontal member 503, while lower parts are secured to the rail members 309 of the conveyor 30. A pair of main piston and cylinder units 505 and a pair of auxiliary piston and cylinder units 506 for turning the conveyor 30 and the piling-up bed 501 are provided. These units are hydraulically operated. Each unit 505 is pivotally mounted on the stationary frame 80, and its piston rod 5051 is pivotally mounted on the conveyor frame 301. Each unit 506 is pivotally mounted on the stationary frame so as to be turnable within a small range limited. A spherical bearing seat 507 is secured to the conveyor frame 301 at a position closer to the frame end 301A than the position at which the piston rod 5051 of the unit 505 is pivotally mounted. A spherical member 5062 at the fore end of a piston rod 5061 can abut on the receiving spherical bearing seat 507. When the piston rods 5051 and 5061 are withdrawn in the cylinder tubes, the conveyor 30 lies at a position at which it can receive the boards from the conveyor 100. When the piston rod 5051 is fully projected from the cylinder tube, the piling-up bed 501 assumes the horizontal posture.

The discharge device 60 is composed of two push rods 602 which comprises wheels 601 capable of rolling in snug engagement with the rod members 504 of the piling-up bed 501 and which are parallel to the conveyor frame 301. Chains 604 are coupled to the lower ends of the push rods 602 so as to move the push rods along the members 504 and which are driven by a motor 603, and roller conveyors 605 are installed on the vertical frames 502 of the piling-up bed 501. The motor 603 is hydraulically operated. Each chain 604 is extended over a sprocket 606 which is rotatably fitted on the sprocket shaft 303 of the conveyor 30, and a sprocket 608 which is secured to a shaft 607 rotatably supported on the horizontal member 503 of the piling-up bed. The shaft 607 is driven by the motor 603 secured to the member 503. When the push rod 602 is not used, it is received between the rail members 309 of the conveyor 30. The board support 308 can be received between the rod members 504 of the piling-up bed 501 and between the rod member 504 and the roller conveyor 605. The conveyor 605 stated above may also be in the form of an array of a large number of rotatable balls.

Figure 2:
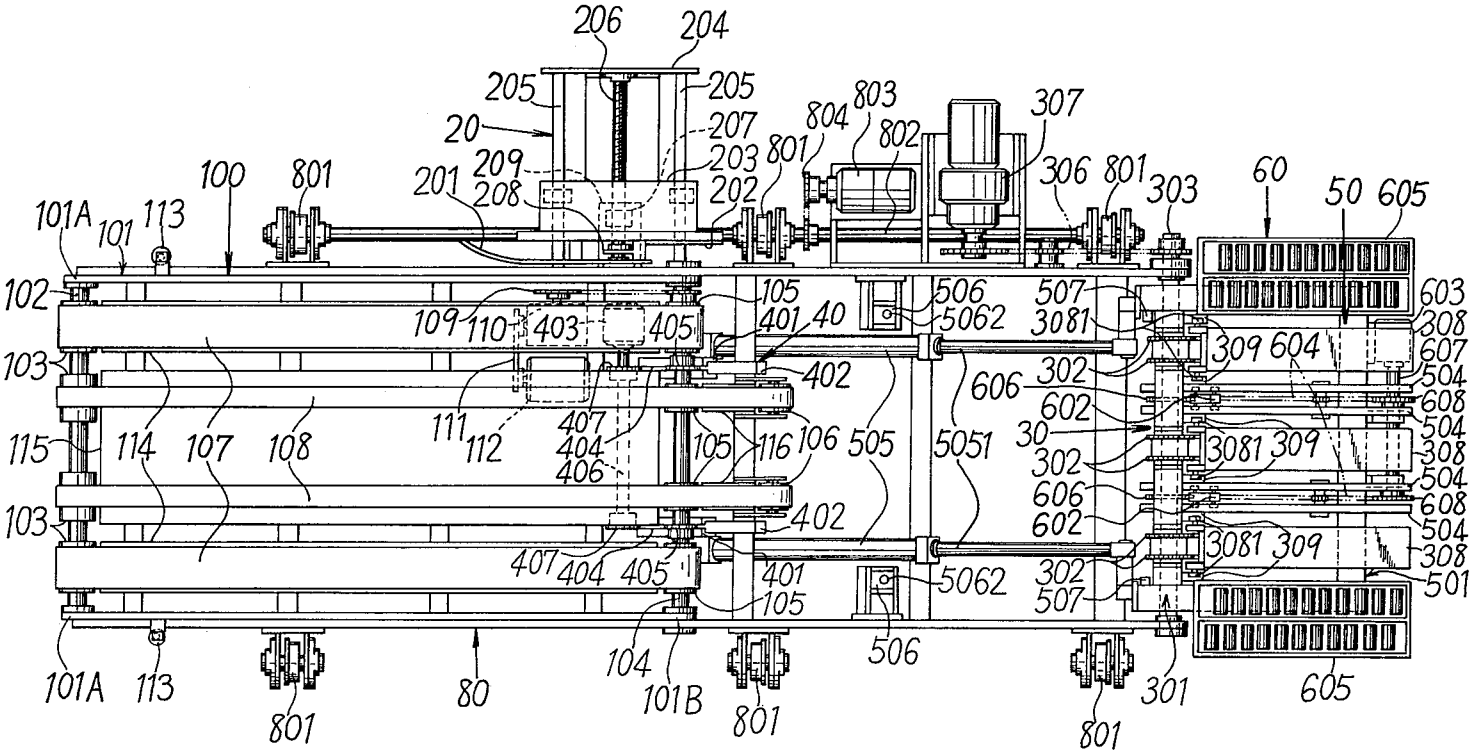
FIG. 2 is a plan view of the board piling-up apparatus in which a piling-up bed of a piling-up device is in the horizontal state.

As illustrated in FIGS. 1 and 2, the stationary frame 80 has wheels 801, and it can be moved in the direction orthogonal to the board feed direction by the wheels. The three wheels 801 on one side of the frame 80 are borne by a single shaft 802, which is driven through a chain transmission 804 by a motor 803 supported on the frame 80.

Figure 3:
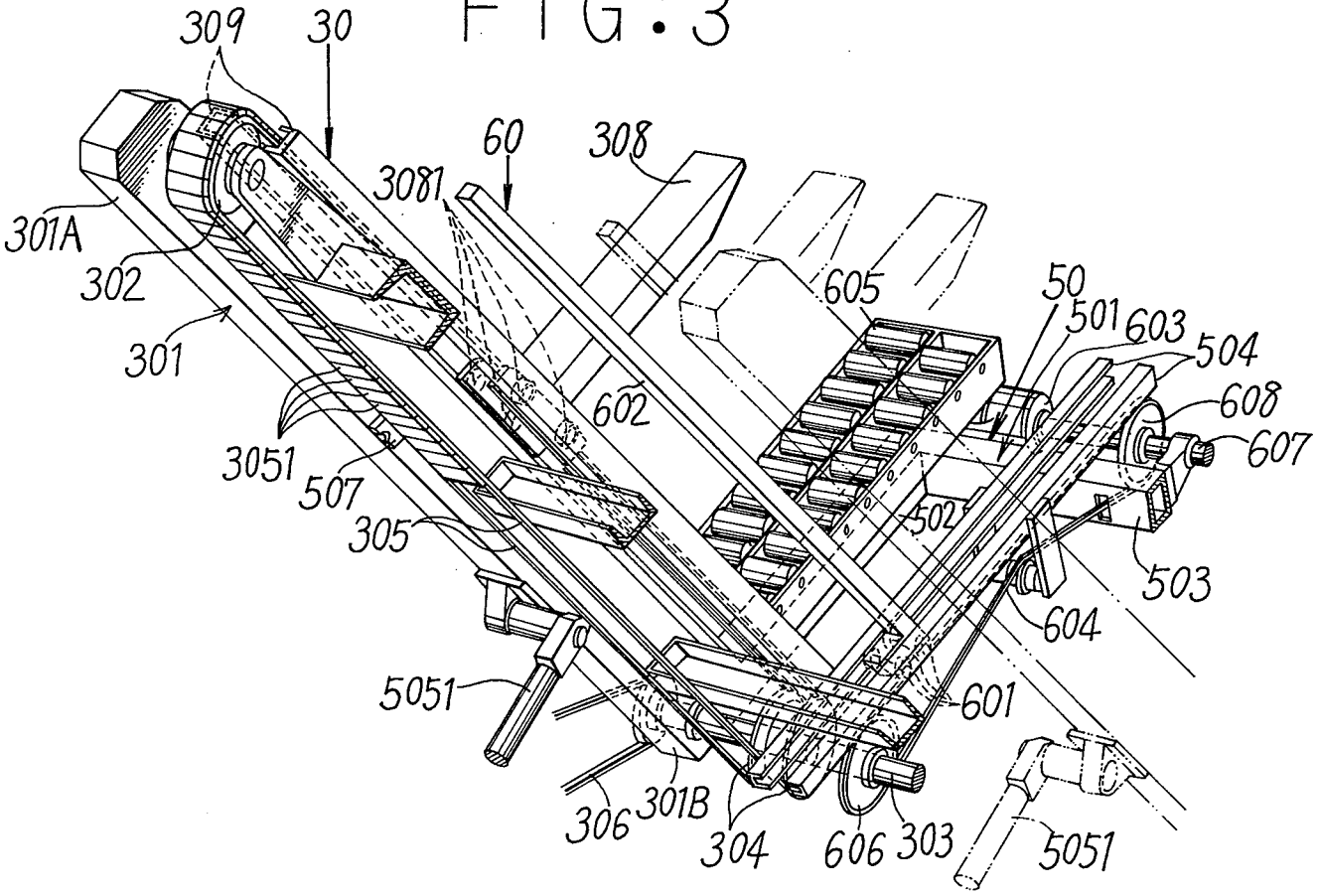
FIG. 3 is a perspective view showing parts of a second conveyor, the piling-up device and a board discharge device.

In operation, the job of piling up boards fed in the form of small bundles (hereinafter termed "board blocks") 10 by the apparatus illustrated in FIGS. 1 to 3 is discussed below. First, the rods 402 of the stopper device 40 are caused to descend, the conveyor 30 is brought into the board receiving position, the board supports 308 are arranged at the feed end of the conveyor 30, i.e., the board reception initiating position, and the push rods 602 of the discharge device 60 are received in the conveyor 30. Under such state, the first conveyor 100 is operated.

The board blocks 10 are fed lying flatly by a conveyor (not shown) transfer onto the first conveyor 100. The board blocks 10 are erected on the first conveyor 100 by a workman. In this case, in order to prevent the occurrence of warping of the boards during storage of the board blocks in the piled-up state, the board blocks 10 are erected by reversing the front and rear sides of the adjacent board blocks. The erected board blocks 10 are alternately struck against the front plate 201 and the rear plate 202 of the arranging device 20 by the workman, so that the positions of the side ends of the boards are made uniform. The reason why the front plate 201 and the rear plate 202 are alternately used is that, when the boards are thereafter piled up, the side ends of the boards blocks are zigzagged to discriminate between the board blocks whose board surfaces face upwards and the board blocks whose board surfaces face downwards. The board blocks 10 raised are shifted to the second conveyor 30 and reclined on the board supports 308 in succession. Each time the conveyor 30 receives one block 10, it is advanced by the thickness of the block. When a predetermined number of blocks 10 are received, the conveyor is continuously operated to transport the blocks 10 to to the piling-up bed 501. Simultaneously with the initiation of the continuous operation of the conveyor 30, the rods 402 of the stopper device 40 are protruded above the delivery end of the first conveyor 100. Thereafter, until the board supports 308 are returned to the board reception initiating positions, the blocks 10 erected on the first conveyor 100 are supported on the rods 402. As soon as the blocks 10 on the conveyor 30 reach the piling-up bed 501, the piston and cylinder units 505 and 506 of the piling-up device 50 are started, and the conveyor 30 and the piling-up bed 501 begin to turn. At the initial stage of the turning of the device 50, mainly the auxiliary units 506 lift the conveyor 30. After the piston rods 5061 of the auxiliary units 506 have fully projected, then only the main units 505 turn the conveyor 30 and the bed 501. When the board blocks 10 are piled up on the piling-up bed 501 by the piling-up device 50, the push rods 602 of the discharge device 60 are moved to the fore end of the piling-up bed 501. Thus, the board blocks 10 piled up are moved on the roller conveyors 605 and discharged from the piling-up bed 501.

Immediately after the board blocks 10 have been discharged, the motor 603 of the discharge device 60, the piston and cylinder units 505 and 506 of the piling-up device 50 and the motor 307 of the conveyor 30 are reversed, and the discharge device 60, the piling-up device 50 and the board supports 308 are returned to the original positions. When the board supports 308 revert to the board reception initiating position, the rods 402 of the stopper device 40 are lowered, and the board blocks 10 which have accumulated are then transfered to the conveyor 30 while being supported by the board supports 308. Subsequently, until the predetermined number is reached, the blocks 10 are successively shifted from the conveyor 100 to the conveyor 30.

Thereafter, the same operations as described above are repeated.

As set forth above, according to the present invention, boards which are fed lying flatly can be promptly and reliably piled up to a desired height and discharged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Board piling-up apparatus wherein boards, such as corrugated boards, which are individually fed lying flat or in the form of small bundles and which are collected in an erected posture, the collected boards being subsequently turned to be piled up, and thereafter the piled up boards are discharged, said board piling-up apparatus comprising:

a first conveyor which receives said boards fed lying in a flat posture and on which said boards are erected;

an arranging device which is disposed on one side of said first conveyor in order to push against the side ends of said boards erected on said first conveyor and to thus position said side ends uniformly;

said arranging device comprises a front plate which is substantially vertical and which is arranged on one side of said first conveyor along said first conveyor, and a rear plate which is substantially vertical and which is arranged behind said front plate so as to protrude from one side end of said front plate as viewed in a direction orthogonal to a feed direction of said first conveyor;

a second conveyor which has a board support capable of reciprocating between a feed end and a delivery end in combination with a transporting member;

said transporting member receives said boards erected on said first conveyor until a predetermined number is reached, and feeds said boards while supporting them by said board support;

a stopper device which can protrude above said delivery end of said first conveyor to support said boards erected on said first conveyor;

a piling-up device which has a scooping bed and a piling-up bed extending from said scooping bed substantially perpendicularly thereto;

said scooping bed lifts and turns said boards which are fed to a predetermined position by said second conveyor and piles them up on said piling-up bed; and a device which discharges said boards from said piling-up bed.

2. The board piling-up apparatus as defined in claim 1, wherein said first conveyor is a belt conveyor.

3. The board piling-up apparatus as defined in claim 1 wherein said second conveyor comprises parallel chains which are driven under the state under which they are extended over feed end sprockets arranged in spaced manner and delivery end sprockets arranged in a spaced manner, and that in order to allow said board support to reciprocate along with said chains, a lower end part of said board support is coupled with said chains and fitted in rail members parallel to said chains.

4. The board piling-up apparatus as defined in claim 1, wherein said scooping bed of said piling-up device is said second conveyor itself, and that said board supports can be received in said piling-up bed of said piling-up device.

5. The board piling-up apparatus as defined in claim 1, wherein said device which discharges said boards from said piling-up bed of said piling-up device comprises a push rod which can reciprocate in a posture parallel to said scooping bed between a position at which it is received in said scooping bed of said piling-up device and a fore end of said piling-up bed, and a conveyor which is provided in said piling-up bed.

6. The board piling-up apparatus as defined in claim 1, wherein said stopper device is designed to protrude straightforward from a position below said first conveyor to above the delivery end of said first conveyor.

7. The board piling-up apparatus as defined in claim 1, wherein said second conveyor is inclined downwardly from the feed end thereof to the delivery end.

8. Board piling-up apparatus wherein boards, such as corrugated boards, which are individually fed lying flat or in the form of small bundles and which are collected in an erected posture, the collected boards being subsequently turned to be piled-up, and thereafter the piled-up boards are discharged, said board piling-up apparatus comprising:

a first conveyor which receives said boards fed lying in a flat posture and on which said boards are erected;

an arranging device which is disposed on one side of said first conveyor in order to push against the side ends of said boards erected on said first conveyor and to thus position said side ends uniformly;

said arranging device comprises a front plate which is substantially vertical and which is arranged on one side of said first conveyor along said first conveyor, and a rear plate which is substantially vertical and which is arranged behind said front plate so as to protrude from one side end of said front plate as viewed in a direction orthogonal to a feed direction of said first conveyor;

a second conveyor which has a board support capable of reciprocating between a feed end and a delivery end in combination with a transporting member;

said second conveyor being inclined downwardly from the feed end thereof to the delivery end;

said transporting member receives said boards erected on said first conveyor until a predetermined number is reached, and feeds said boards while supporting them by said board support;

a stopper device which can protrude above said delivery end of said first conveyor and separate from said second conveyor to support said boards erected on said first conveyor;

a piling-up device which has a scooping bed and a piling-up bed extending from said scooping bed substantially perpendicularly thereto;

said scooping bed lifts and turns said boards which are fed to a predetermined position by said second conveyor and piles them up on said piling-up bed; and a device which discharges said boards from said piling-up bed.

9. Board piling-up apparatus wherein boards, such as corrugated boards, which are individually fed lying flat or in the form of small bundles and which are collected in an erected posture, the collected boards being subsequently turned to be piled up, and thereafter the piled up boards are discharged, said board piling-up apparatus comprising:

a first conveyor which receives said boards fed lying in a flat posture and on which said boards are erected;

a second conveyor which has a board support capable of reciprocating on the transferring side of the conveyor between a feed end and a delivery end in combination with a transporting member;

said transporting member and said support intermittently receive said boards erected on said first conveyor until a predetermined number is reached, and thereafter continuously feeds said boards while supporting them by said board support;

a stopper device which can protrude above said delivery end of said first conveyor at substantially the same time as the start of said continuous feeding operation of the second conveyor and then continues to protrude until said board support returns to the position for starting the next board receiving operation in order to support said boards erected on said first conveyor;

a piling-up device which has a scooping bed and a piling-up bed extending from said scooping bed substantially perpendicularly thereto;

said scooping bed lifts and turns boards which are fed to a predetermined position by said second conveyor and piles them up on said piling-up bed; and a device which discharges said boards from said piling-up bed.

10. The board piling-up apparatus as defined in claim 9, wherein an arranging device is disposed on one side of said first conveyor in order to push against the side ends of said boards erected on said first conveyor and to thus position said side ends uniformly.

11. The board piling-up apparatus as defined in claim 9, wherein said second conveyor comprises parallel chains which are driven under the state under which they are extended over feed end sprockets arranged in spaced manner and delivery end sprockets arranged in a spaced manner, and that in order to allow said board support to reciprocate along with said chains, a lower end part of said board support is coupled with said chains and fitted in rail members parallel to said chains.

12. The board piling-up apparatus as defined in claim 9, wherein said scooping bed of said piling-up device is said second conveyor itself, and that said board support can be received in said piling-up bed of said piling-up device; and said device which discharges said boards from said piling-up bed of said piling-up device comprises a push rod which can reciprocate in a posture parallel to said scooping bed between a position at which it is received in said scooping bed of said piling-up device and a fore end of said piling-up bed, and a conveyor which is provided in said piling-up bed.

13. The board piling-up apparatus as defined in claim 9, wherein said stopper device is designed to protrude straightforward from a position below said first conveyor to above the delivery end of said first conveyor.

14. The board piling-up apparatus as defined in claim 9, wherein said second conveyor is inclined downwardly from the feed end thereof to the delivery end.

15. Board piling-up apparatus wherein boards, such as corrugated boards, which are individually fed lying flat or in the form of small bundles and which are collected in an erected posture, the collected boards being subsequently turned to be piled up, and thereafter the piled up boards are discharged, said board piling-up apparatus comprising:

a first conveyor which receives said boards fed lying in a flat posture and on which said boards are erected;

an arranging device which is disposed on one side of said first conveyor in order to push against the side ends of said boards erected on said first conveyor and to thus position said side ends uniformly;

a second conveyor which has a board support capable of reciprocating on the transferring side of the conveyor between a feed end and a delivery end in combination with a transporting member;

said second conveyor is inclined downwardly from the feed end thereof to the delivery end: and said transporting member and said support intermittently receive said boards erected on said first conveyor until a predetermined number is reached, and thereafter continuously feeds said boards while supporting them by said board support;

a stopper device which can protrude straightforward from a position below said first conveyor to above said delivery end of said first conveyor at substantially the same time as the start of said continuous feeding operation of the second conveyor and then continues to protrude until said board support returns to the position for starting the next board receiving operation in order to support said boards erected on said first conveyor;

a piling-up device which has a scooping bed and a piling-up bed extending from said scooping bed substantially perpendicularly thereto;

said scooping bed lifts and turns boards which are fed to a predetermined position by said second conveyor and piles them up on said piling-up bed; and a device which discharges said boards from said piling-up bed.

* * * * *

UNITED STATES PATENT AND TRADEMARK OFFICE

CERTIFICATE OF CORRECTION

PATENT NO. : 4,103,786

DATED : August 1, 1978

INVENTOR(S) : Masateru TOKUNO

It is certified that error appears in the above-identified patent and that said Letters Patent are hereby corrected as shown below:

IN THE HEADING OF THE PATENT:

Under Foreign Application Priority Data, change "Oct. 11, 1975" to --Nov. 10, 1975--.

Signed and Sealed this

*Third* Day of *April 1979*

[SEAL]

*Attest:*

RUTH C. MASON
*Attesting Officer*

DONALD W. BANNER
*Commissioner of Patents and Trademarks*